US011666510B2

(12) United States Patent
Rivard

(10) Patent No.: US 11,666,510 B2
(45) Date of Patent: Jun. 6, 2023

(54) SMART PILL DISPENSER

(71) Applicant: Derek Rivard, St Louis Park, MN (US)

(72) Inventor: Derek Rivard, St Louis Park, MN (US)

( * ) Notice: Subject to any disclaimer, the term of this patent is extended or adjusted under 35 U.S.C. 154(b) by 31 days.

(21) Appl. No.: 17/484,126

(22) Filed: Sep. 24, 2021

(65) Prior Publication Data

US 2022/0096330 A1 Mar. 31, 2022

Related U.S. Application Data

(60) Provisional application No. 63/085,149, filed on Sep. 30, 2020.

(51) Int. Cl.
*A61J 7/00* (2006.01)

(52) U.S. Cl.
CPC ..... *A61J 7/0076* (2013.01); *A61J 7/0069* (2013.01); *A61J 2200/30* (2013.01)

(58) Field of Classification Search
CPC ..... A61J 7/0076
See application file for complete search history.

(56) References Cited

U.S. PATENT DOCUMENTS

| | | | | |
|---|---|---|---|---|
| 8,727,180 | B2 * | 5/2014 | Zonana | A61J 7/0076 221/288 |
| 2010/0006585 | A1 * | 1/2010 | Flowers | A61J 7/0409 221/7 |
| 2017/0231871 | A1 * | 8/2017 | Aldasouqi | B65D 83/04 221/203 |
| 2019/0142698 | A1 * | 5/2019 | Bukstein | G01P 15/00 221/1 |

* cited by examiner

*Primary Examiner* — Gene O Crawford
*Assistant Examiner* — Ayodeji T Ojofeitimi
(74) *Attorney, Agent, or Firm* — Jose W. Jimenez; Jimenez Law Firm

(57) ABSTRACT

A smart pill dispenser has a cylindrical interior housing portion divided into an upper storage portion, a lower control and dispensing portion, and a removable top. A cylindrical carousel with an open top and bottom has a plurality of spoke walls forming interior pill containers. A hole portion disposed through a bottom wall of the upper wall portion defines a pathway through the housing assembly. A slide assembly leads from the hole to a tray for dispensed pills. A motor coupled to a rechargeable battery and actuator assembly has a shaft coupled to an axle portion of the spoke divider and is designed to laterally rotate the spoke and axle. A computerized control system assembly is communicatively coupled to the motor assembly and a user-control assembly. The user-control assembly is disposed on an outer surface of the housing and is designed to interface with users directly or wirelessly.

5 Claims, 8 Drawing Sheets

SMART PILL DISPENSER

This application claims priority to and the benefit of U.S. Provisional application with Ser. No. 63/085,149, filed on Sep. 30, 2020, with the same title, the contents of which are incorporated by reference it its entirety.

FIELD OF THE INVENTION

The inventive concept relates generally to a smart pill dispenser.

BACKGROUND

Currently, there are a number of solutions for pill dispensers. One of these solutions attempts to utilize standard pill boxes, but this solution fails to meet the needs of the market because the user may forget to take pills. Another solution attempts to have someone administer the pills to the person, but this solution is similarly unable to meet the needs of the market because there may not be someone available. Still another solution seeks to utilize a timed dispenser, but this solution also fails to meet market needs because people may take the wrong pills. Therefore, there currently exists a need in the market for an apparatus that timely dispenses pills to users.

SUMMARY OF TIM INVENTION

The inventive concept is a smart pill dispenser for a user having a housing assembly with a substantially cylindrical interior portion divided into an upper storage portion and a lower control and dispensing portion. A removable top portion of the housing assembly is designed to provide access to the storage portion. A cylindrical carousel member with an open top and bottom is horizontally disposed within the upper storage portion of the housing assembly, the cylindrical carousel member radially divided by a spoke and axle divider assembly, a plurality of spoke members forming interior wall members substantially the height of the cylindrical carousel member, the dividers creating a plurality of interior pill containers. A hole portion disposed through a horizontal dividing wall portion that forms the base of the upper storage portion of the housing assembly, the hole portion defining an open pathway from the upper storage portion of the housing assembly to the lower control and dispensing portion, the hole portion further aligned with at least one interior pill container of the cylindrical carousel member. A slide assembly is disposed through the lower control and dispensing portion of the housing assembly and beneath the open pathway and leading to a tray portion disposed for access to dispensed pills by a user. A motor assembly is disposed within the lower control and dispensing portion of the housing assembly and electrically coupled to a rechargeable battery and actuator assembly. A shaft assembly is disposed from an upper portion of the motor assembly and is coupled to the axle portion of the spoke and axle divider assembly and is designed to laterally rotate the spoke and axle divider assembly and carousel assembly a selected degree on demand, the selected degree moving at least one interior pill container over the open pathway in place of at least one adjacent interior pill container previously occupying the position. A computerized control system assembly is disposed within the lower control and dispensing portion of the housing assembly and is communicatively coupled to the motor assembly and a user control assembly. A radio wave receiver and sender assembly is disposed within the lower control and dispensing portion of the housing assembly and is communicatively coupled to the computerized control system assembly. The user control assembly is disposed on an outer surface of the housing assembly and is designed to receive and send instructions and messages from and to the user.

In one embodiment of the smart pill dispenser for a user, a smartphone application is communicatively coupled to the computerized control system assembly through the radio wave receiver and sender assembly and is designed to receive and send instructions and messages from and to the user. In one embodiment of the smart pill dispenser for a user, a video camera assembly is disposed within the housing assembly and is designed to record the user taking dispensed pills, the video camera assembly communicatively coupled to the smartphone application or another computerized application.

In one embodiment of the smart pill dispenser for a user, the radial spoke and axle divider assembly creates seven interior pill containers, a marker or divider disposed on the spoke and axle divider assembly to denote the start of a pill dispensing period.

In one embodiment of the smart pill dispenser for a user, a supplemental, removable, radial spoke and axle assembly is designed to interleave the spoke and axle divider assembly and to divide the cylindrical carousel member into fourteen interior pill containers.

On demand can mean a command from a user, from the computerized control system, or from an external control system.

It would be advantageous to have a smart pill dispenser that is smartphone compatible. Furthermore, it would be advantageous to have a smart pill dispenser that is rechargeable. Still further, it would be advantageous to have a smart pill dispenser that is reusable.

The inventive concept may video-record medication adherence and communicate with its users in real time via Wi-Fi and a mobile app to ensure regimen adherence. The dispenser may have a seven- or fourteen-day supply that administers doses daily to its users and may track capabilities to identify patterns and trends.

The inventive concept advantageously fills the aforementioned deficiencies by providing a smart pill dispenser, which provides a way for users to remember to take their daily pills.

The smart pill dispenser may have a video camera.

The smart pill dispenser may have a pill splitter.

The smart pill dispenser fulfills the need for a timed pillbox.

Among other things, it is an advantage of the inventive concept to provide a smart pill dispenser that does not suffer from problems or deficiencies associated with prior solutions.

It is still further an advantage of the inventive concept to be Wi-Fi compatible.

Still further, the smart pill dispenser has a dispensing button and tray.

The inventive concept contains dividers, for example, a 7/14-day medication carousel, and a removable divider. The inventive concept is equipped with a charger port, dispensing tray, and internal battery.

The inventive concept now will be described more fully hereinafter with reference to the accompanying drawings, which are intended to be read in conjunction with both this summary, the detailed description, and any preferred and/or particular embodiments specifically discussed or otherwise disclosed. This inventive concept may, however, be embodied in many different forms and should not be construed as limited to the embodiments set forth herein; rather, these embodiments are provided by way of illustration only and so that this disclosure will be thorough, complete, and will fully convey the full scope of the inventive concept to those skilled in the art.

DETAILED DESCRIPTION OF THE INVENTION

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Figure 1:
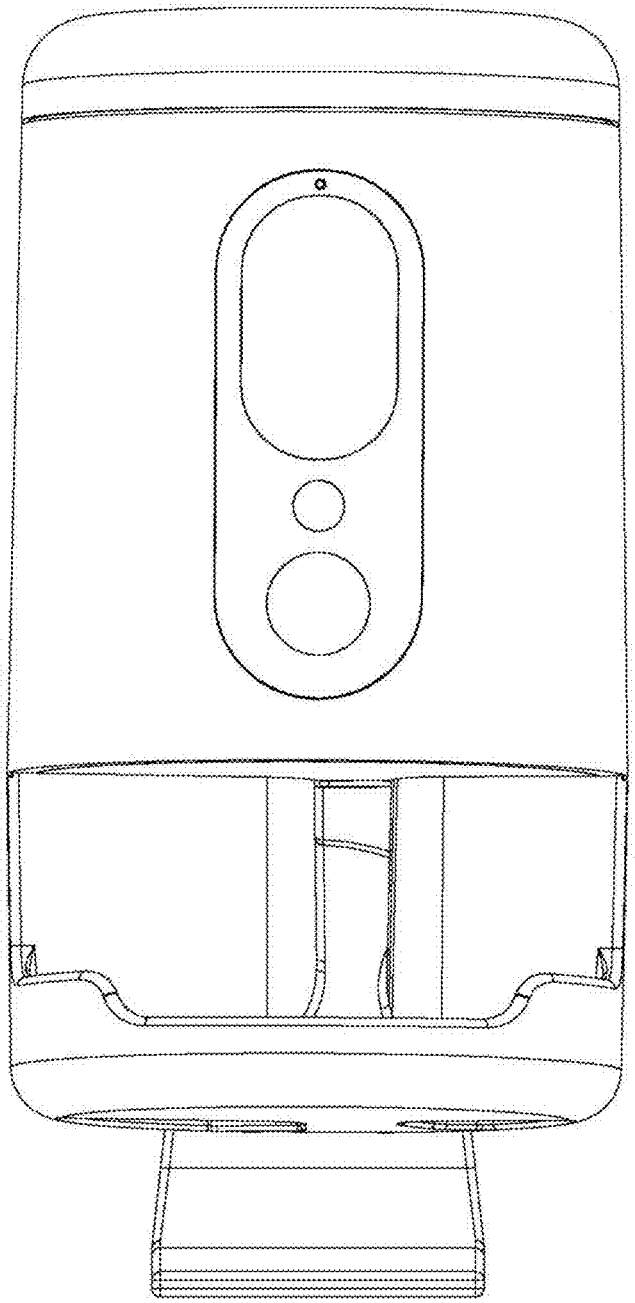
FIG. 1 illustrates the front of the smart pill dispenser.
Figure 2:
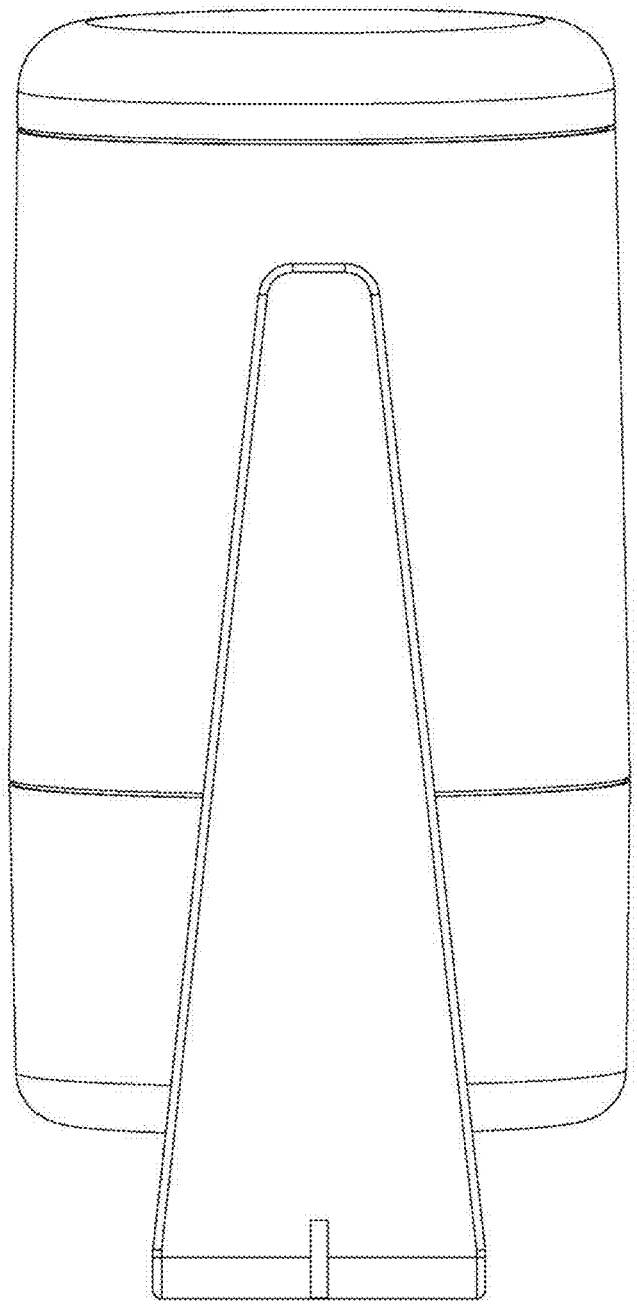
FIG. 2 illustrates the back of the smart pill dispenser.
Figure 3:
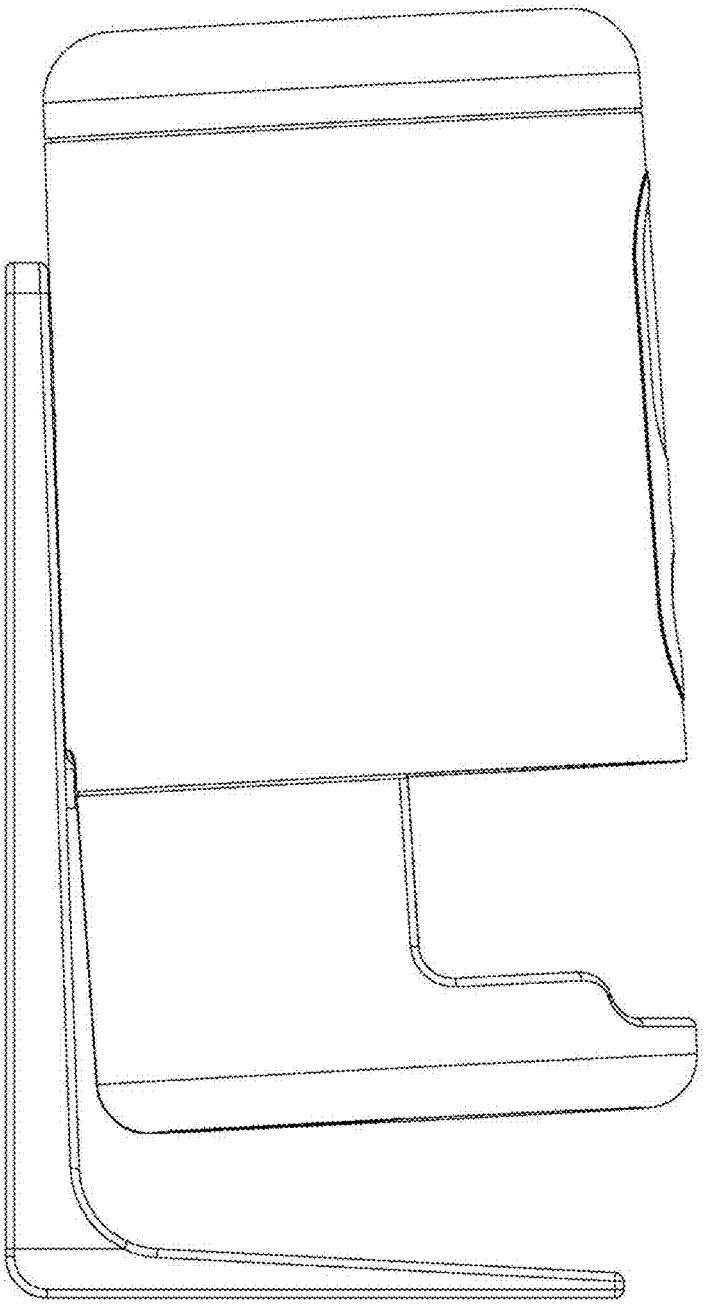
FIG. 3 illustrates the side of the smart pill dispenser.
Figure 4:
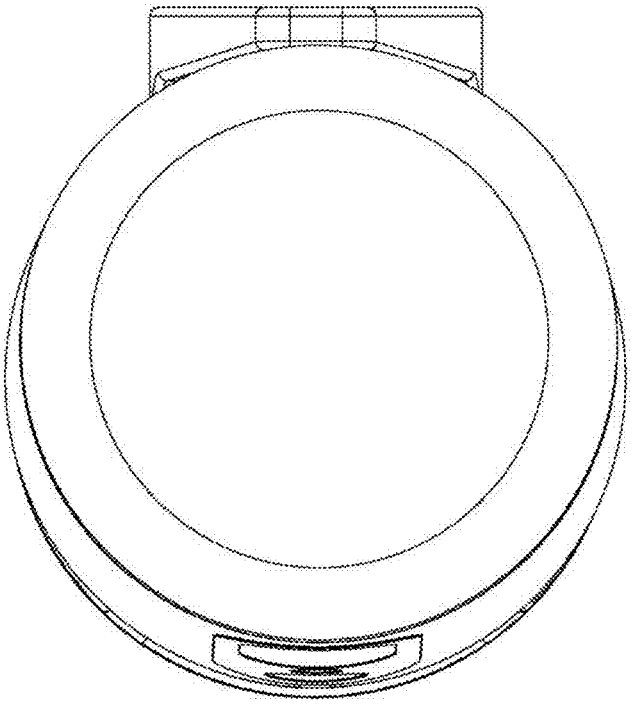
FIG. 4 illustrates the top of the smart pill dispenser.
Figure 5:
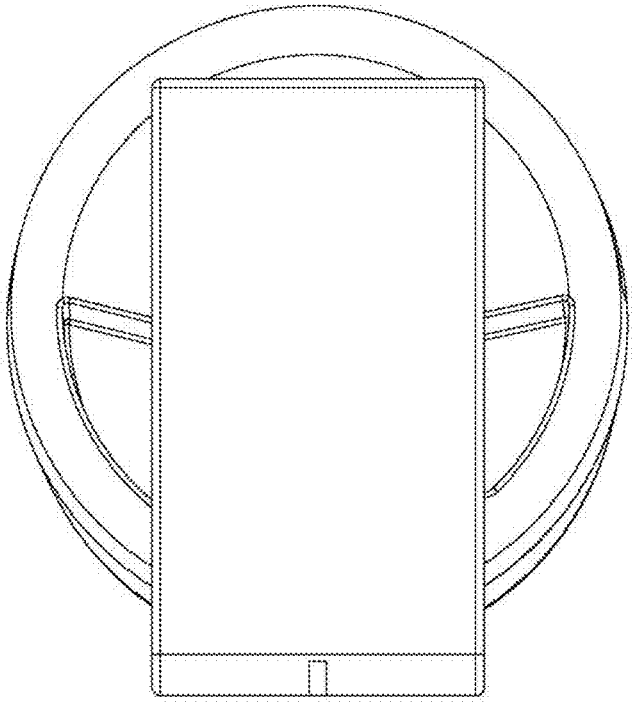
FIG. 5 illustrates the bottom of the smart pill dispenser.
Figure 6:
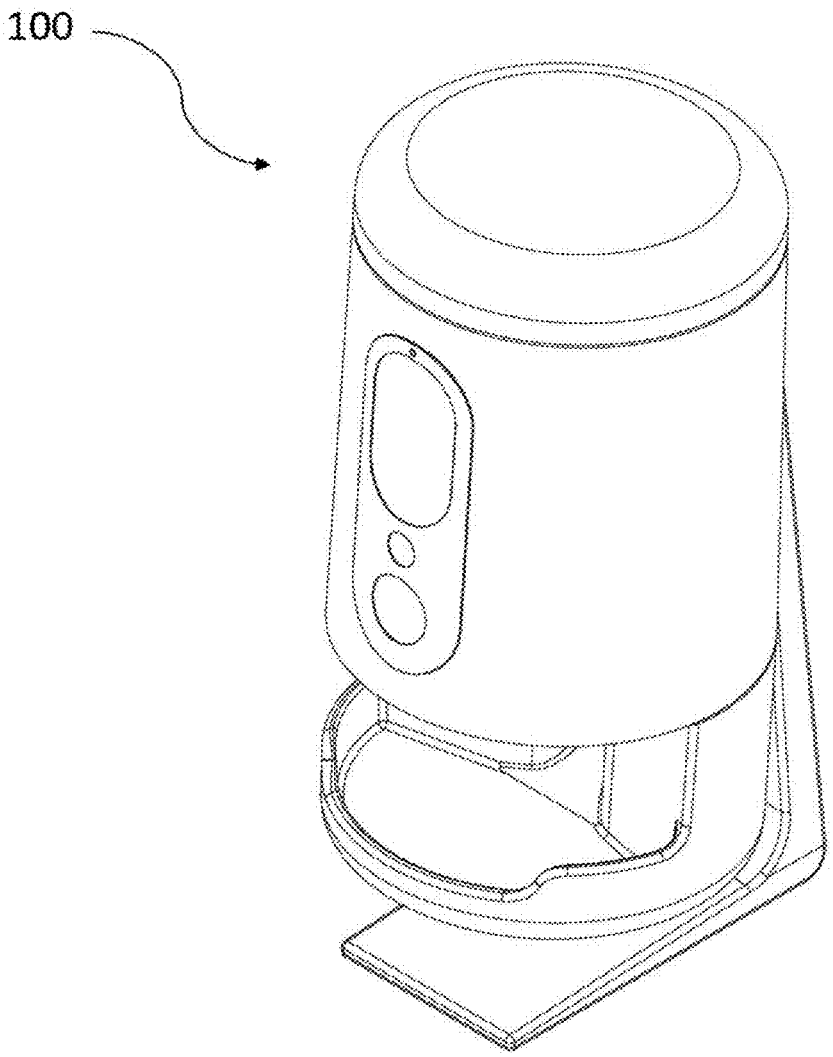
FIG. 6 illustrates the perspective view of the smart pill dispenser.
Figure 7:
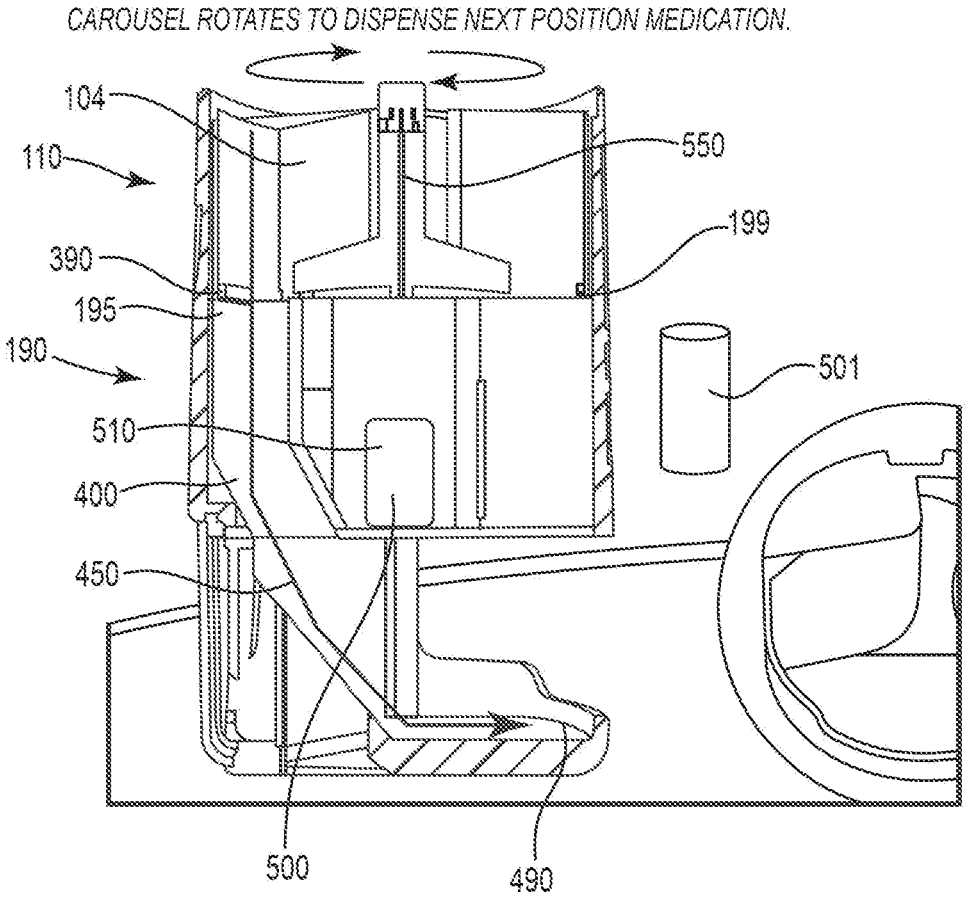
FIG. 7 illustrates a cross-section view of the smart pill dispenser.
Figure 8:
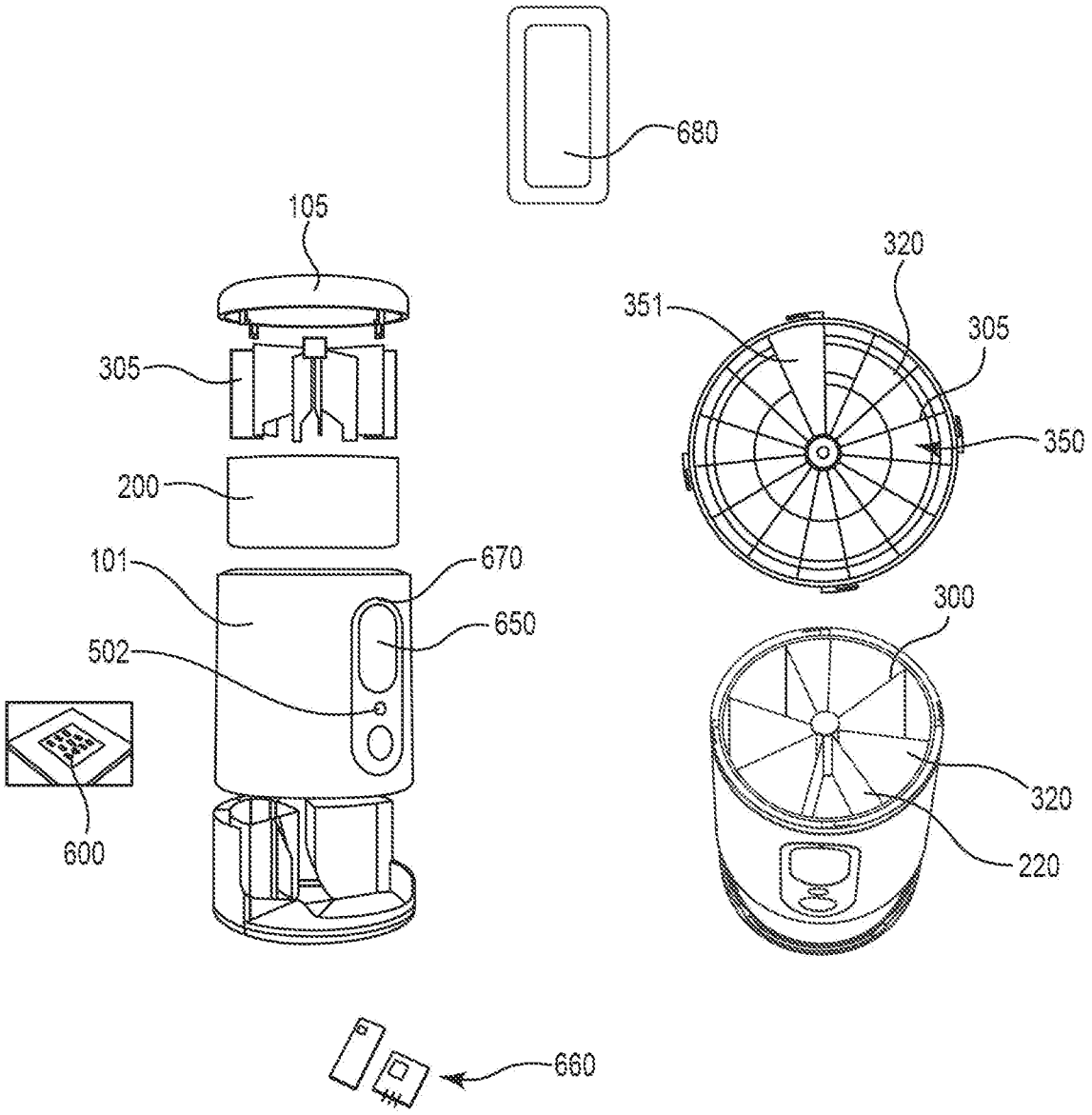
FIG. 8 illustrates interior components of the smart pill dispenser.

Referring to the figures, FIGS. 1-8 illustrate the inventive concept is a smart pill dispenser 10 for a user having a housing assembly 100 with a substantially cylindrical interior portion 104 divided into an upper storage portion 110 and a lower control and dispensing portion 190. A removable top portion of the housing assembly 105 is designed to provide access to the storage portion 110. A cylindrical carousel member 200 with an open top and bottom is horizontally disposed within the upper storage portion of the housing assembly 110, the cylindrical carousel member 200 radially divided by a spoke and axle divider assembly 300, a plurality of spoke members 320 forming interior wall members 220 substantially the height of the cylindrical carousel member 200, the dividers creating a plurality of interior pill containers 350. A hole portion disposed through a horizontal dividing wall portion 195 that forms the base of the upper storage portion of the housing assembly 199, the hole portion 195 defining an open pathway 400 from the upper storage portion of the housing assembly 110 to the lower control and dispensing portion 190, the hole portion 195 further aligned with at least one interior pill container 350 of the cylindrical carousel member 300. A slide assembly 450 is disposed through the lower control and dispensing portion of the housing assembly 190 and beneath the open pathway 400 and leading to a tray portion 490 disposed for access to dispensed pills by a user.

In this example embodiment, a motor assembly 500 is disposed within the lower control and dispensing portion of the housing assembly 190 and is electrically coupled to a rechargeable battery 501 and actuator assembly 502. A shaft assembly 550 is disposed from an upper portion of the motor assembly 510 and coupled to the axle portion 360 of the spoke and axle divider assembly 300 and is designed to laterally rotate the spoke and axle divider assembly 300 and carousel assembly 200 a selected degree on demand, the selected degree moving at least one interior pill container 350 over the open pathway 400 in place of at least one adjacent interior pill container 350 previously occupying the position. A computerized control system assembly 600 is disposed within the lower control and dispensing portion of the housing assembly 190 and is communicatively coupled to the motor assembly 500 and a user control assembly 650.

A radio wave receiver and sender assembly 660 is disposed within the lower control and dispensing portion of the housing assembly 190 and communicatively coupled to the computerized control system assembly 600. The user control assembly 650 is disposed on an outer surface of the housing assembly 101 and is designed to receive and send instructions and messages from and to the user. In one embodiment of the smart pill dispenser for a user, a smartphone application 680 is communicatively coupled to the computerized control system assembly 600 through the radio wave receiver and sender assembly 660 and is designed to receive and send instructions and messages from and to the user. In one embodiment of the smart pill dispenser for a user, a video camera assembly 670 is disposed within the housing assembly 100 and is designed to record the user taking dispensed pills, the video camera assembly 670 communicatively coupled to the smartphone application 680 or another computerized application.

In one embodiment of the smart pill dispenser for a user, the radial spoke and axle divider assembly 300 creates seven interior pill containers 350, a marker or divider 351 disposed on the spoke and axle divider assembly 300 to denote the start of a pill dispensing period.

In one embodiment of the smart pill dispenser for a user, a supplemental, removable, radial spoke and axle assembly 305 is designed to interleave the spoke and axle divider assembly 300 and to divide the cylindrical carousel member 200 into fourteen interior pill containers.

The following patents are incorporated by reference in their entireties: U.S. Pat. No. 9,235,690, 20090281657A1, and 20140326636A1.

While the inventive concept has been described above in terms of specific embodiments, it is to he understood that the inventive concept is not limited to these disclosed embodiments. Upon reading the teachings of this disclosure, many modifications and other embodiments of the inventive concept will come to mind of those skilled in the art to which this inventive concept pertains, and which are intended to be and are covered by both this disclosure and the appended claims. It is indeed intended that the scope of the inventive concept should be determined by proper interpretation and construction of the appended claims and their legal equivalents, as understood by those of skill in the art relying upon the disclosure in this specification and the attached drawings.

The invention claimed is:

1. A smart pill dispenser for a user comprising:

a housing assembly with a substantially cylindrical interior portion divided into an upper storage portion and a lower control and dispensing portion;

a removable top portion of the housing assembly adapted to provide access to the storage portion of the housing assembly;

a cylindrical carousel member horizontally disposed within the upper storage portion of the housing assembly, the cylindrical carousel member with an open top and bottom radially divided by a spoke and axle divider assembly, a plurality of spoke members forming interior wall members substantially the height of the cylindrical carousel member, the dividers creating a plurality of interior pill containers;

a hole portion disposed through a horizontal dividing wall portion forming the base of the upper storage portion of the housing assembly, the hole portion defining an open pathway from the upper storage portion of the housing assembly to the lower control and dispensing portion, the hole portion further aligned with at least one interior pill container of the cylindrical carousel member;

a slide assembly disposed through the lower control and dispensing portion of the housing assembly and beneath the open pathway and leading to a tray portion disposed for access to dispensed pills by a user;

a motor assembly disposed within the lower control and dispensing portion of the housing assembly and electrically coupled to a rechargeable battery and actuator assembly;

a shaft assembly disposed from an upper portion of the motor assembly and coupled to the axle portion of the spoke and axle divider assembly and adapted to laterally rotate the spoke and axle divider assembly and carousel assembly a selected degree on demand, the selected degree moving at least one interior pill container over the open pathway in place of at least one adjacent interior pill container previously occupying the position;

a computerized control system assembly disposed within the lower control and dispensing portion of the housing assembly and communicatively coupled to the motor assembly and a user control assembly;

a radio wave receiver and sender assembly disposed within the lower control and dispensing portion of the housing assembly and communicatively coupled to the computerized control system assembly; and the user control assembly disposed on an outer surface of the housing assembly and adapted to receive and send instructions and messages from and to the user.

2. The smart pill dispenser for a user of claim 1 wherein a smartphone application is communicatively coupled to the computerized control system assembly through the radio wave receiver and sender assembly and adapted to receive and send instructions and messages from and to the user.

3. The smart pill dispenser for a user of claim 2 wherein a video camera assembly is disposed within the housing assembly and adapted to record the user taking dispensed pills, the video camera assembly communicatively coupled to the smartphone application or another computerized application.

4. The smart pill dispenser for a user of claim I wherein the radial spoke and axle divider assembly creates seven interior pill containers, a marker or divider disposed on the spoke and axle divider assembly to denote the start of a pill dispensing period.

5. The smart pill dispenser for a user of claim 4 wherein a supplemental, removable, radial spoke and axle assembly is adapted to interleave the spoke and axle divider assembly and to divide the cylindrical carousel member into fourteen interior pill containers.

* * * * *